United States Patent [19]

Strange

[11] 4,417,403

[45] Nov. 29, 1983

[54] BOW SIGHT

[76] Inventor: Ronald L. Strange, Rte. 1, Box 752, Elizabethtown, Ky. 42701

[21] Appl. No.: 482,230

[22] Filed: Apr. 5, 1983

[51] Int. Cl.[3] ..... F41G 1/00; F41G 1/46

[52] U.S. Cl. ..... 33/265; 124/87

[58] Field of Search ..... 33/265; 124/87

[56] References Cited

U.S. PATENT DOCUMENTS

| | | | |
|---|---|---|---|
| 2,959,860 | 11/1960 | Kowalcyn | 33/265 |
| 2,982,026 | 5/1961 | Peterson | 33/265 |
| 3,271,863 | 9/1966 | Harrington | 33/265 |
| 4,162,579 | 7/1979 | James | 33/265 |
| 4,224,741 | 9/1980 | Perry | 33/265 |

*Primary Examiner*—Willis Little

*Attorney, Agent, or Firm*—Larson and Taylor

[57] ABSTRACT

An adjustable sight for aiming an archery bow at a target is disclosed. The bow sight includes a bow bracket which is adjustably attached to the bow and a planar sight bracket which is adjustably attached to the bow bracket in a generally vertical plane. A front sight is mounted at one end of the sight bracket and extends horizontally from the sight bracket. A distance member is disposed generally parallel to and adjacent to the sight bracket and is pivotally mounted thereto about a horizontal axis perpendicular to the plane of the sight bracket. A rear sight is mounted to the distance member and extends horizontally away from the distance member. Range indicia are located on the sight bracket and a reference mark is located on the distance member. By appropriately moving the distance member so that the reference mark is aligned with the appropriate range indicia, the aimed line of sight of the bow is adjusted for distance of the target from the bow. In addition, by pivotally mounting the sight bracket to the bow bracket about a horizontal pivot axis, the tendency to shoot further left or right of the target at increasing distances is compensated for. Different ranges of distances can be provided for with the present bow sight by changing the pivot point of the distance member between two pivot points provided.

8 Claims, 3 Drawing Figures

BOW SIGHT

FIELD OF THE INVENTION

The present invention relates generally to archery bows, and more particularly to a bow sight for a compound bow which is adjustable for different distances.

BACKGROUND OF THE INVENTION

In normal shooting of a bow, the back hand is used as a rear sight. This means that the position of the backhand must always be in exactly the same location. For the front sight, a pin is positioned at the front of the bow. Frequently, a number of pins are spaced vertically along the front of the bow at intervals corresponding to increasing target distances of approximately ten yards. Thus, the archer selects the pin, or frequently the location between the two pins which corresponds to the distance of the target from the archer. Obviously, there is a certain amount of guesswork as to exactly where to aim between the pins for distances of the target between the distances indicated by the pins.

In order to provide greater accuracy for archery shooting, various bow sights have been disclosed in the prior art. Although these prior art bow sights are better than using pins, there still exists a need for an easily adjustable, simple bow sight which is accurate at a variety of distances.

SUMMARY OF THE INVENTION

An adjustable bow sight for aiming an archery bow at a target where the bow is disposed in a vertical plane is provided. The bow sight includes a bow bracket which is attached to the bow above the arrow rest. An elongate planar sight bracket which is disposed in a plane generally parallel to the vertical plane of the bow is attached to the bow bracket. A front sight is mounted at the front of the sight bracket and extends perpendicularly away from the plane of the sight bracket. An elongate distance member which is disposed generally parallel and adjacent to the sight bracket is pivotally mounted at the rear of the sight bracket about a generally horizontal axis perpendicular to the plane of the sight bracket. A rear sight is mounted to the distance member and extends horizontally away from the distance member so as to align with the front sight to define an aimed line of sight at the target. A holding means is provided to prevent free rotation of the distance member relative to the sight bracket about the pivot point. Range indicia is located on the sight bracket and a reference mark located on the distance member is provided adjacent this indicia. In this manner, the aimed line of sight is adjusted for distance of the target from the bow by pivoting the distance member relative to the sight bracket to bring the reference mark into alignment with an appropriate range indicia.

In the preferred embodiment of the present invention, the sight bracket is pivotally mounted to the bow bracket about a horizontal pivot axis which is generally parallel to the vertical plane of the bow. A sight holding means prevents free rotation of the sight bracket relative to the bow bracket so that the sight bracket can be locked in a desired position. By pivoting and locking the sight bracket in a canted or inclined position relative to the vertical axis of the bow, the tendency of the archer to shoot further left or right of the target at increasing distances from the target is automatically compensated for. As the sight bracket is canted from the vertical plane of the bow, each movement of the distance member to adjust for a greater distance to the target results in a slight inward or outward compensating movement of the rear sight relative to the vertical plane of the bow. By trial and error, the archer can determine how great a canting or inclination of the sight bracket is sufficient to compensate for his own tendency.

According to the preferred embodiment, the front sight and rear sight are adjustably movable in a direction perpendicular to the vertical plane of the bow. In addition, two pivot points for the distance member are provided which are located along a horizontal line parallel to the plane of the bow. By moving the pivot point of the distance member, the distance of the rear sight from the front sight is changed and a different distance compensation for the bow is achieved. In this manner, a smaller total range adjustment is provided at one pivot point with a finer adjustment for increments of distance, while at the other pivot point a larger range of distance is provided with a correspondingly grosser adjustment for each increment of distance. In order to best adapt the bow sight for the user and for the bow, the sight bracket is vertically adjustable relative to the bow bracket and also horizontally adjustable relative to the bow bracket. In addition, the bow bracket is adjustable relative to the bow so that the minimum range distance of the bow sight is adjustable.

It is a feature of the present invention that a simple, easily operated bow sight which adjusts for the distance of the target from the bow is provided.

It is an advantage of the present invention that the tendency of the archer to shoot further left or right of the target at increasing distances can be compensated for.

It is a further advantage of the present invention that by changing the pivot point of the distance member, a different distance compensation for the bow allowing for greater accuracy can be provided for the same movement of the distance member.

Other features and advantages of the present invention are stated in or apparent from a detailed description of a presently preferred embodiment of the invention found hereinbelow.

DETAILED DESCRIPTION OF THE PREFERRED EMBODIMENT

Figure 2:
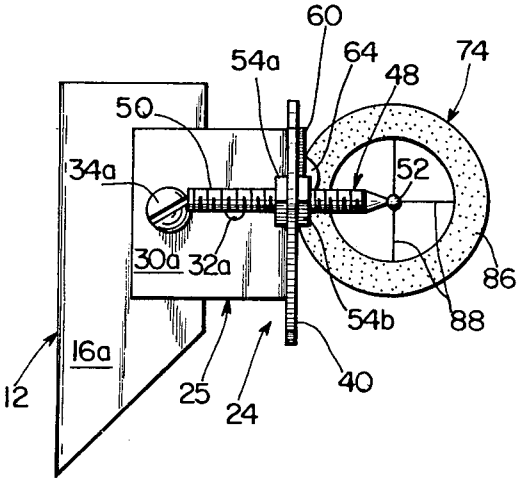
FIG. 2 is a left side elevation view of the bow sight depicted in FIG. 1.
Figure 1:
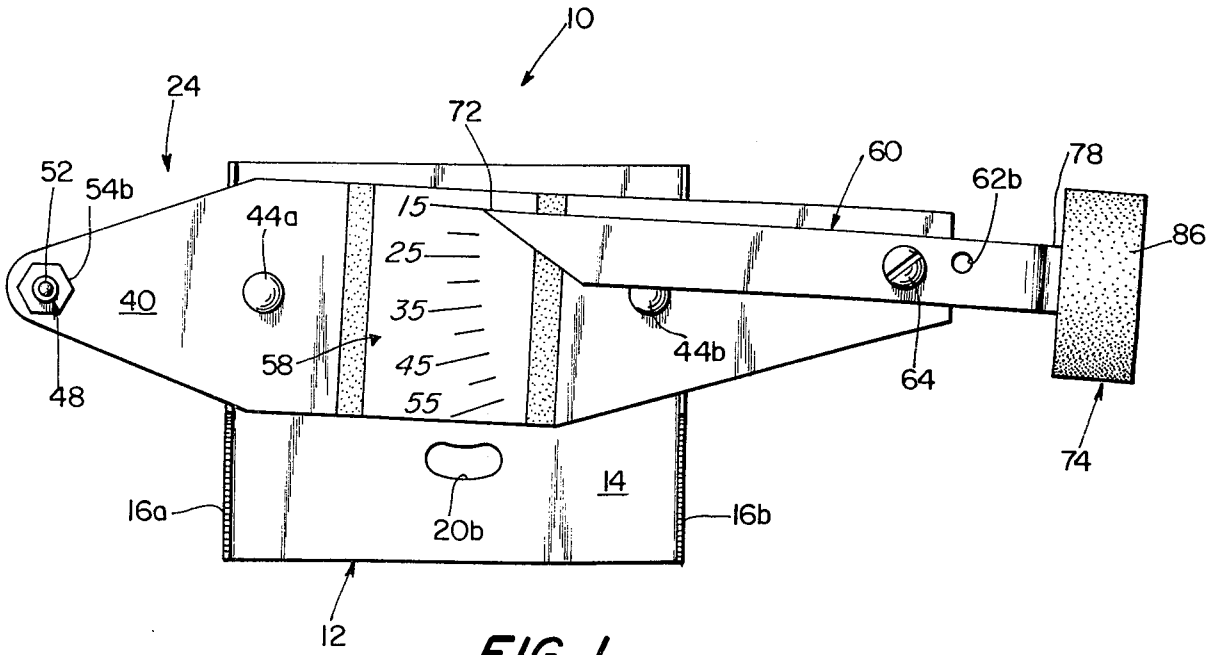
FIG. 1 is a front elevation view of a bow sight according to the present invention.
Figure 3:
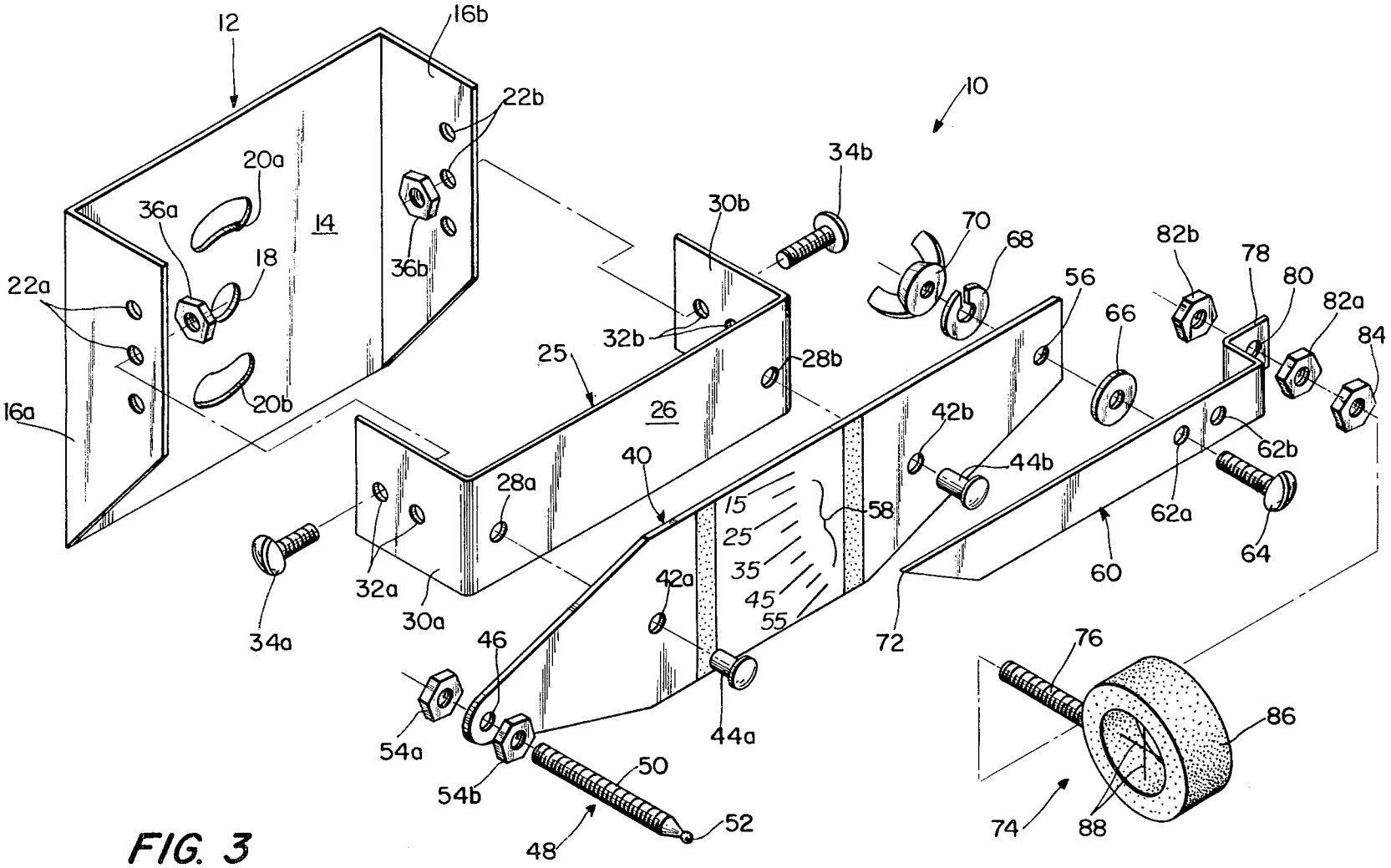
FIG. 3 is an exploded perspective view of the bow sight depicted in FIG. 1.

With reference now to the drawings in which like numerals represent like elements throughout the several views, a presently preferred embodiment of a bow sight 10 is depicted in FIGS. 1, 2 and 3. Bow sight 10 includes a bow bracket 12 having a generally planar face 14 and out-turned ends 16*a* and 16*b*. Located in the middle of face 14 is an aperture 18. Above and below aperture 18 are elongate slots 20*a* and 20*b*. Located in ends 16*a* and 16*b* are a series of apertures 22*a* and 22*b*, respectively. Bow bracket 12 is attached to the bow by suitable screws (not shown) which pass through aperture 18 and one or both of slots 20*a* and 20*b* and which are then received in the threaded holes found in the universal mounting bracket provided on most brands of compound bows. In mounting bow bracket 12, face 14 is mounted so as to be in a plane substantially parallel to the vertical plane formed by the compound bow.

Attached to bow bracket 12 is a sight bracket 24. Sight bracket 24 includes a mounting bracket 25 and a sight plate 40. Mounting bracket 25 includes a face 26 which is generally parallel to face 14 of bow bracket 12. Located at either end of face 26 are apertures 28*a* and 28*b*. Outstanding from face 26 of mounting bracket 25 are ends 30*a* and 30*b*. Ends 30*a* and 30*b* have apertures 32*a* and 32*b*, respectively, therein. Mounting bracket 25 is attached to bow bracket 12 by suitable screws 34*a* and 34*b*, to which nuts 36*a* and 36*b* are, respectively, attached. As shown best in FIG. 3, screws 34*a* and 34*b* are passed through suitable apertures 32*a* and 32*b* and then through apertures 22*a* and 22*b*, respectively, in bow bracket 12. When nuts 36*a* and 36*b* are received on screws 34*a* and 34*b*, respectively, screws 34*a* and 34*b* form a pivot means whereby sight bracket 24 is pivoted relative to bow bracket 12. By tightning nuts 36*a* and 36*b*, sight bracket 24*a* can be held at any desired cant or inclination relative to bow bracket 12. It should be noted, however, that face 26 of mounting bracket 25 is generally parallel to face 14 of bow bracket 12.

Attached to face 26 of mounting bracket 25 is a sight plate 40. Sight plate 40 is in the form of a flat plate having two apertures 42*a* and 42*b* which align with apertures 28*a* and 28*b*, respectively, of mounting bracket 25. Sight place 40 is attached to mounting bracket 25 by rivets 44*a* and 44*b* which pass through apertures 42*a*, 28*a* and 42*b*, 28*b*, respectively. Located at the foward end of sight plate 40 is an aperture 46 in which a front sight 48 is received. Front sight 48 includes a threaded portion 50 and a round tip 52 which is conveniently colored red. Nuts 54*a* and 54*b* are provided on either side of distance member 40 and threadably receive threaded portion 50 of front sight 48. In this manner, front sight 48 extends perpendicular to the plane of sight plate 40 and the distance which tip 52 extends beyond distance member 40 is adjustable by turning nuts 54*a* and 54*b*. When the desired location of tip 52 is achieved, nuts 54*a* and 54*b* are tightened against sight plate 40 to hold front sight 48 immovably on sight plate 40. Located at the opposite end of sight plate 40 is an aperture 56. Disposed on the face of sight plate 40 away from mounting bracket 25 is a series of range indicia 58.

Pivotally attached to the rear of sight plate 40 is a distance member 60. Distance member 60 includes two apertures 62*a* and 62*b* which are offset from one another along the longitudinal axis of distance member 60. A screw 64 passes through one of apertures 62*a* and 62*b* and through aperture 56 of sight plate 40 to pivotally attach distance member 60 to sight bracket 24. Screw 64 passes through a washer 66 disposed between distance member 60 and sight plate 40. On the other side of sight plate 40, screw 64 passes through a spring washer 68 and is threadably received in a wing nut 70. By tightning down on wing nut 70 to the point where spring washer 68 exerts a resilient force against wing nut 70 and sight plate 40, distance member 60 is pivotally attached to sight plate 40 but is not freely movable about screw 64. The force required to pivot distance member 60 is varied by tightning on wing nut 70 and is preferably of sufficient force to allow distance member 60 to be movable by hand but to otherwise to be frictionally held in place.

The forward end of distance member 60 comes to a point and forms a reference mark 72. At the other end, a rear sight 74 including a threaded portion 76 is attached to an offset portion 78 of distance member 60. An aperture 80 is provided in offset portion 78 through which threaded portion 76 extends. Located on either side of aperture 80 are nuts 82*a* and 82*b* through which treaded portion 76 is threadably received. In a manner similar to front sight 48, rear sight 74 extends perpendicularly away from distance member 60, and hence perpendicularly away from sight bracket 24, and the distance of rear sight 74 from distance member 60 is adjustable by movement of nuts 82*a* and 82*b*. In addition, nuts 82*a* and 82*b* can be snugged down to hold rear sight 74 stationary. Nut 84 is also threadably received on threaded portion 76 and is snugged against ring 86 of rear sight 74 to prevent ring 86 from rotating about threaded portion 76. Located inside of ring 86 are cross hairs 88.

In operation, bow sight 10 functions in the following manner. Initially, bow sight 10 is assembled as depicted in FIGS. 1 and 2. Next, bow sight 10 is attached to a compound bow using the mounting screws and mounting holes provided with the bow. The mounting holes are provided on the bow for the use of sights and the mounting of quivers. The mounting holes are provided above the arrow rest, and different manufacturers locate these mounting holes at different distances above the arrow rests. As a general rule, three inches above the arrow rest is usually the most comfortable position for the location of the bow sight. Thus, where the mounting holes are provided approximately two inches above the arrow rest, the mounting screws are passed through apertures 18 and 20*b* so that front sight 48 and rear sight 74 are located approximately three inches above the arrow rest. Where the mounting holes are located approximately four inches above the arrow rest, the mounting screws are passed through apertures 20*a* and 18 so that, again, front sight 48 and rear sight 74 are located approximately three inches above the arrow rest. Where the mounting holes are located approximately three inches above the arrow rest, the screws are passed through aperture 18 and one or the other of apertures 20*a* or 20*b* so that front sight 48 and rear sight 74 are approximately three inches above the arrow rest.

It should be noted that face 14 of bow bracket 12 is mounted substantially parallel to the plane of the bow. As one of the mounting screws is passed through slots 20*a* or 20*b*, bow bracket 12 must be initially rotated about the screw passing through aperture 18 to a set or predetermined position. This position corresponds to the minimum target distance with which bow sight 10 is to be used. After an initial use of bow sight 10, this position can be suitably marked and bow bracket 12 rotated to this position each time bow sight 10 is reattached to the bow. After bow bracket 12 is rotated to this set position, the mounting screws are snugged down against face 14 of bow bracket 12 to securely hold bow sight 10 to the bow.

After bow bracket 12 is attached to the appropriate mounting holes on the bow, the archer may still desire that the placement of front sight 48 and rear sight 74 be somewhat further adjusted as to height or distance from bow bracket 12. In order to change the height of front sight 48 and rear sight 74, screws 34*a* and 34*b* can be located in the appropriate one of respective apertures 22*a* and 22*b* to slightly change the vertical position of front sight 48 and rear sight 74 further. In addition, screws 34*a* and 34*b* can be located in one or the other of apertures 32*a* and 32*b*, respectively, to also slightly change the lateral position of front sight 48*a* and rear sight 74. With these two adjustments, front sight 48 and rear sight 74 are adjustable over a wide range which should be suitable for most archers.

With bow bracket 12 and mounting bracket 25 appropriately adjusted, front sight 48 or rear sight 74 are horizontally adjusted relative to sight plate 40 and to one another to correct for any aiming of the bow to the right or left of the target. In addition, to a minor extent, the horizontal positions of front sight 48 and rear sight 74 can be adjusted in tandem to further position the aimed line of sight horizontally relative to bow bracket 12 as the archer desires.

In order to adjust the aimed line of sight of front sight 48 and rear sight 74 for the distance to the target, distance member 60 is suitably rotated about screw 64. The first time that bow sight 10 is used, the archer experiments to find exactly where the various marks comprising range indicia 58 should be located. Conveniently, range indicia 58 is located on a strip of material which the archer can mark with a pen or pencil. In this manner, the archer can determine exactly where reference mark 72 is located when front sight 48 and rear sight 74 are aligned to hit a target at a predetermined distance. With further experimentation, a series of range indicia 58 as shown is marked on sight plate 40. Consequently, each time bow sight 10 is used, the same range indicia 58 are referred to and distance member 60 appropriately rotated to adjust rear sight 74 for the range of the target.

In order to adjust distance member 60, wing nut 70 is loosened somewhat so that distance member 60 is lightly held by friction and easily rotatable about screw 64. Once reference mark 72 is aligned with appropriate range indicia 58, wing nut 70 is tightened to securely hold distance member 60 at the desired location.

It should be noted that screw 64 can be received in distance member 60 in either aperture 62*a* or 62*b*. As shown in FIG. 3, where screw 64 is received in aperture 62*a*, the approximate range of distances through which rear sight 74 is adjusted can be approximately 15 to 55 yards. However, where screw 64 is received in aperture 62*b*, rear sight 74 is moved closer to front sight 48. In the new position, a movement of reference mark 72 through a predetermined arc results in a smaller overall movement of rear sight 74 than when screw 64 was in aperture 62*a*. For this reason, range indicia 58 is no longer appropriate and a new range indicia on a separate strip of material is conveniently used. This range indicia covers a smaller range of distances because rear sight 74 is closer to front sight 48. However, the smaller range of distances is spread over the same arc of movement of reference mark 72 so that a more accurate placement of reference mark 72 at a desired range is achieved. Thus, bow sight 10 is usable with a range indicia 58 covering a large range of distances with a distance compensation which for every ten yards, for example, is relatively small; and for a different range of distances which is smaller than the first range, but with the distance compensation for every ten yards fairly large so that a more accurate placement of reference mark 72 at a specified range is possible. By way of example, the large range of distances can be 15 to 75 yards and the small range of distances 15 to 55 yards. Obviously, other ranges suitable for a particular user are possible.

As the distance of the target from the archer increases, there is a tendency for the archer to shoot progressively further left or right of the target. The magnitude and direction of this tendency is different for each individual archer. In order to compensate for this tendency of a particular individual, sight bracket 24 is canted about screws 34*a* and 34*b* so that face 26 and sight plate 40 are no longer vertical and parallel to the plane of the bow but are instead inclined somewhat to the plane of the bow. The direction of rotation of sight bracket 24 depends upon whether the tendency is to shoot left or right, and the magnitude of rotation depends upon the magnitude of the tendency to shoot left or right.

This compensation occurs because as sight bracket 24 is canted, the axis of rotation of distance member 60 is similarly canted. Therefore, when distance member 60 is rotated about screw 64 to adjust rear sight 74 for a new target range, this rotation occurs about an axis which is no longer horizontal. Consequently, besides a change in vertical orientation of rear sight 74, there is also a slight horizontal movement of rear sight 74. The magnitude of this slight horizontal movement is dependent upon the amount of canting of sight plate 24. Obviously, the greater the angle of canting, the greater the horizontal movement. This horizontal movement causes the aimed line of sight of front sight 48 and rear sight 74 to move left or right, compensating for the tendency of the archer to shoot further left or right at increasing distances. Obviously, there will be some trial and error for each individual archer to determine the particular angle of canting which is suitable to compensate for the individual archer's tendency to shoot left or right. However, once the best angle of canting is found, nuts 36*a* and 36*b* are tightened so that sight bracket is fixed and can no longer be moved out of this desired angle of inclination. Alternatively, suitable markings can be made between ends 30*a* and 30*b* and ends 16*a* and 16*b*, respectively, so that sight bracket 24 can be returned to the desired angle of inclination whenever desired.

Although the present invention has been described where rear sight 74 is vertically moved relative to front sight 48, it should be appreciated that rear sight 74 could be stationary and front sight 48 could be moved relative to rear sight 74 instead. In addition, instead of using two strips of material on which different range indicia 58 are located, a single scale could be provided on sight plate 40 which contains both ranges of indicia. Alternately, a single scale could be provided on sight plate 40 with markings from, for example, zero to one hundred. The archer would then determine which markings are appropriate for which yardages when screw 64 is located in aperture 62*a* and in aperture 62*b*.

It should also be appreciated that the various elements of bow sight 10 are exemplary and a number of other elements serving the same function could be substituted therefore. For example, instead of a cross hair sight 74 as depicted, a "V" sight could be used. Various fastening means besides those shown are also possible.

Thus, although the present invention has been described with respect to an exemplary embodiment thereof, it will be understood by those of ordinary skill in the art that variations and modifications are possible within the scope and spirit of the invention.

I claim:

1. An adjustable sight for aiming an archery bow at a target where said bow is disposed in a vertical plane, comprising:

a bow bracket which is attached to the bow above an arrow rest;

an elongate planar sight bracket disposed in a plane generally parallel to the vertical plane of the bow, said sight bracket being attached to said bow bracket;

a first sight mounted at one end of said sight bracket, said first sight extending perpendicularly away from said planar sight bracket;

an elongate distance member disposed generally parallel and adjacent to said sight bracket, said distance member including a distance pivot means located adjacent the other end of said sight bracket for pivotally mounting said distance member to said sight bracket about a horizontal axis perpendicular to the plane of said sight bracket;

a second sight mounted to said distance member, said second sight extending horizontally away from said distance member and aligning with said first sight to define an aimed line of sight at the target;

a distance member holding means for preventing free rotation of said distance member relative to said sight bracket about said distance pivot means;

range indicia located on one of said sight bracket or said distance member; and a reference mark located on the other of said sight bracket or said distance member and adjacent said range indicia whereby the aimed line of sight is adjusted for distance of the target from the bow by pivoting said distance member relative to said sight bracket about said distance pivot means to bring said reference mark in alignment with an appropriate range indicia.

2. An adjustable bow sight as claimed in claim 1 and further including a sight pivot means for pivotally mounting said sight bracket to said bow bracket about a horizontal pivot axis generally parallel to the vertical plane of the bow, and a sight holding means for preventing free rotation of said sight bracket relative to said bow bracket such that the tendency to shoot further left or right of the target at increasing distances from the target is compensated for by canting said sight bracket from the vertical plane of the bow about said sight pivot means an appropriate amount whereby movement of said distance member to adjust for a greater distance to the target results in a slight inward or outward compensating movement of said second sight.

3. An adjustable bow sight as claimed in claim 2 wherein said first sight is a front sight and said second sight is a rear sight.

4. An adjustable bow sight as claimed in claim 3 wherein said sights are movably adjustable in a direction generally perpendicular to the vertical plane of the bow.

5. An adjustable bow sight as claimed in claim 4 wherein said distance pivot means includes two pivot points spaced from each other along a horizontal line parallel to the plane of the bow and a means for selectively moving the pivot axis of said distance member to one or the other of said pivot points whereby the distance of said first sight from said second sight is changed and thus a different distance compensation for the bow is achieved with each said pivot point for the same pivoting movement of said distance member.

6. An adjustable bow sight as claimed in claim 5 and further including a bow adjusting means for vertically adjusting said sight bracket relative to said bow bracket.

7. An adjustable bow sight as claimed in claim 6 and further including a sight adjusting means for horizontally adjusting said sight bracket relative to said bow bracket.

8. An adjustable bow sight as claimed in claim 7 wherein said bow bracket includes a bow bracket adjusting means for slightly rotating said bow bracket relative to the bow about a horizontal axis whereby the minimum distance of the bow sight is determined.

* * * * *